United States Patent [19]

Carr et al.

[11] 4,132,630

[45] Jan. 2, 1979

[54] METHOD FOR SEPARATING SOLIDS FROM COAL LIQUIDS

[75] Inventors: Norman L. Carr, Allison Park; Edgar L. McGinnis, Gibsonia, both of Pa.

[73] Assignee: Gulf Research & Development Company, Pittsburgh, Pa.

[21] Appl. No.: 893,084

[22] Filed: Apr. 3, 1978

[51] Int. Cl.[2] ..... C10G 29/06

[52] U.S. Cl. ..... 208/177; 208/283

[58] Field of Search ..... 208/177, 251 R, 253, 208/8, 283; 210/75

[56] References Cited

U.S. PATENT DOCUMENTS

| | | | |
|---|---|---|---|
| 3,138,551 | 6/1964 | Jones | 210/75 |
| 4,012,314 | 3/1977 | Goldberger et al. | 208/251 R |
| 4,057,484 | 11/1977 | Malek | 208/8 |
| 4,060,478 | 11/1977 | Lang | 208/8 |

OTHER PUBLICATIONS

Carman, P. C., "The Action of Filter Aids," Industrial and Engineering Chemistry, vol. 30, No. 10, pp. 1163–1167 (1938).

*Primary Examiner*—George Crasanakis

[57] ABSTRACT

The rate of separation of suspended mineral particles from a coal liquid is increased by adding a mixture of a hydrocarbonaceous oil and a calcium salt, such as calcium carbonate, to the coal liquid. The increase in the separation rate is achieved even though the coal mineral particles naturally contain a calcium salt. The premixing of the calcium salt with hydrocarbonaceous oil considerably enhances the separation rate as compared to the addition of the calcium salt alone even when the hydrocarbonaceous oil is a distillate fraction which is derived from the coal liquid itself.

18 Claims, No Drawings

METHOD FOR SEPARATING SOLIDS FROM COAL LIQUIDS

This invention relates to a process for removing suspended coal mineral particles from coal liquids. Although the suspended particles are referred to herein as coal mineral particles, it is understood that the term coal minerals includes mineral residue, insoluble organic matter or a combination of the two.

Several processes are now being developed for producing deashed liquid and/or solid hydrocarbonaceous fuels from raw coal. One such process is known as the Solvent Refined Coal (SRC) process. This process is a solvation process and is described in a number of patents, including U.S. Pat. No. 3,884,794, which is hereby incorporated by reference. In this process, crushed raw coal is slurried with a solvent comprising hydroaromatic compounds in contact with hydrogen in a first zone at a high temperature and pressure to dissolve hydrocarbonaceous fuel from coal minerals by transfer of hydrogen from the hydroaromatic solvent compounds to the hydrocarbonaceous material in the coal. The mixture is then passed to a second zone wherein dissolved hydrocarbonaceous material reacts with hydrogen while the solvent also reacts with hydrogen to replenish hydrogen lost in the first zone. The hydrogen-enriched solvent is recycled. The dissolved coal liquids contain suspended particles of coal minerals and undissolved coal. The particles are very small, some being of submicron size, and are therefore very difficult to remove from the dissolved coal liquids.

We have found that when a calcium salt is added to a coal liquid containing suspended or dispersed particles of mineral residue prior to a step for the separation of the suspended particles, the solids are separated from the coal liquid at a more rapid rate than would otherwise be possible. Any of the known methods for solids-liquid separation can be applied to a calcium salt-treated coal liquid, including filtration, settling, hydrocloning or centrifugation. Unlike a filter aid which mechanically assists a filtration type of separation only, the calcium salt of this invention assists all methods of solids separation. However, because of the rapid rate of solids removal demonstrable by filtration, the present invention is illustrated in the following examples by the filtration method of solids separation.

It is shown in the following examples that commercial diatomaceous earth filter aid exerts a negative effect upon the filtration rate of a coal liquid when it is added directly to the coal liquid as a body feed. In fact, it has been the experience of the coal liquefaction art that materials known as filter aids and which impart a mechanical effect upon the filtration operation improve the filtration rate of coal liquids only when utilized as a filter precoat material. The finding herein that a calcium salt, such as calcium carbonate, improves the filtration rate of coal liquids indicates that it does not function as a filter aid. The examples presented below show that the improvement in filtration rate due to the effect of calcium carbonate is distinct from and can be superimposed upon the improvement due to the use of a filter aid as a precoat material.

Data presented below provide strong evidence that the discovered advantageous effect of an added calcium salt upon the rate of filtration of a coal liquid is chemical in nature, as contrasted to the mechanical effect exerted by calcium carbonate as a conventional filter aid in filtration systems of the prior art. For example, data are presented below which show that calcium carbonate did not increase the rate of filtration of a coal liquid in filtration tests performed at 400° F. (204° C.), but did increase the filtration rate in similar tests performed at 500° F. (260° C.). If the effect of the calcium carbonate were of the conventional mechanical filter aid type, an improvement in filtration rate would have been apparent at the 400° F. (204° C.) filtration temperature.

The fact that the naturally occurring minerals which are suspended in coal liquids and which are removed during the filtration operation are known to contain a considerable quantity of calcium salts, such as calcium carbonate, constitutes additional evidence that the added calcium salt does not exert a mechanical effect in the filtration procedure. If the effect were mechanical, the calcium carbonate naturally present would itself act as a filter aid. The natural minerals suspended in the coal liquid render the coal liquid extremely difficult to filter, indicating that the effect of the added calcium salt is due to a factor other than the mere presence of calcium carbonate in the coal liquid.

Although we are not bound by any theory, a chemical effect may occur in the coal liquid due to reaction of the added calcium salt with carbon dioxide, which is naturally occurring in the coal liquid, resulting in the crystallization of a coating of calcium carbonate around individual suspended particles of coal minerals, thereby enlarging these particles to render them easier to separate. The coating may also form around a plurality of suspended particles, forming aggregates or clusters of particles. The naturally occurring calcium carbonate in the suspended coal mineral particles may exert a seeding effect for the crystallization of fresh calcium carbonate, or other minerals in the suspended particles may catalyze the crystallization of calcium carbonate around the suspended mineral particles. If the added calcium salt is calcium carbonate, carbon dioxide may be released by the calcium carbonate upon mixing with or dissolution in the premixing hydrocarbonaceous liquid described below, and then be available for the recrystallization. Aside from this released carbon dioxide, carbon dioxide is abundantly available in the coal liquid whether the liquid is under atmospheric or superatmospheric pressure due to its production in the coal liquefaction process because of the considerable rupturing of hydrocarbonaceous coal molecule chains which occurs in the vicinity of the carbon-oxygen bonds, which constitute a weak link in the chain.

A test was conducted to confirm that a coal liquid environment was conducive to the crystallization of calcium carbonate. In this test, calcium acetate was added to tetralin, which is an important component in a solvent for liquefying coal. A carbon dioxide atmosphere was maintained at coal liquefaction temperature and pressure. Calcium carbonate was produced and recovered by filtration. This test demonstrated that calcium carbonate crystallization occurs in a solvent liquid used for coal liquefaction from a calcium salt in the presence of carbon dioxide.

Any calcium salt can be employed which is capable of forming a stable and homogeneous mixture or dispersion in the coal liquid, enabling it to crystallize a calcium carbonate around individual or groups of suspended mineral particles by reacting with carbon dioxide. A combination calcium salt, such as dolomite, which is $CaCO_3 . MgCO_3$, can be employed. Dolomite is also naturally occurring in coal minerals.

Many references disclose the general utility of calcium carbonate as a filter aid in systems other than coal liquids. For example, U.S. Pat. No. 3,138,551 to Jones discloses a process for the filtration of alkaline or caustic liquor in which calcium carbonate particles are utilized as filter aid. The Jones patent reported that in the filtration of sodium aluminate liquor the crystalline form of calcium carbonate known as aragonite was found to be superior as a filter aid as compared to the crystalline form known as calcite. The patent reported that the calcite particles are small, being in the form of spheres having a uniform particle diameter of about 2.5 microns, while aragonite particles are larger, being needle-like and having a width of about 1 to 5 microns and a length of about 5 to about 40 microns.

Since the Jones patent reported that the calcium carbonate functioned as a filter aid, the finding that the relatively large aragonite particles were more effective than the smaller calcite particles was to be expected. A filter aid performs the mechanical function of spacing removed particles at the filter medium during a filtration operation to provide an open channel for the flowing liquid. Relatively large particles of filter aid material are generally superior to smaller particles of filter aid for providing a mechanical spacing function of this type. In contrast, as explained above, in the filtration of coal liquids the calcium carbonate exerts a chemical effect rather than a mechanical effect. Since this chemical effect involves reaction and possibly dissolving of calcium carbonate, it would be expected that the calcite form of calcium carbonate, which has a smaller particle size, would be highly effective. The examples presented below show that the calcite form of calcium carbonate was highly effective for imparting a substantial increase to the filtration rate of coal liquids. Unlike systems utilizing a conventional filter aid, which exerts a mechanical effect, where the small size of the calcite would be an unfavorable factor, the addition of small sized calcite particles was a favorable factor in the filtration of coal liquids.

The calcium carbonate employed in the following filtering test was purchased under the trade name of "Carbium." It comprised calcium carbonate of 96.6 percent purity, substantially entirely in the calcite crystalline form. The calcite particles ranged in size from 0.7 to 9 microns, averaging 2 microns, and were retained on a 325 mesh screen.

The weight of added calcium salt based on volume of mineral-containing coal liquid to be employed in accordance with this invention will vary depending upon the particular calcium salt employed, but will be between about 1 and 100 grams per liter, generally, and between about 10 and 50 grams per liter, preferably. Although the calcium carbonate is introduced to the coal liquid as a body feed prior to filtration, it can also be utilized as a precoat material, or as both a precoat material and a body feed. When calcium carbonate is the calcium salt which is employed, the solids-liquid separation step should occur at a temperature above 400° F. (204° C.), preferably above 425 or 450° F. (218 or 232° C.). Highly superior results are achieved at temperatures of 475 or 500° F. (246 or 260° C.), or higher. Filtration temperatures can range as high as 600° F. (316° C.) in SRC pressurized filters. The calcium carbonate can be added at the same or at a lower or higher temperature than the temperature of the solids-liquid separation step. The calcium salt addition and solids separation step can occur at atmospheric or superatmospheric pressure. In a filtration operation, the pressure must be sufficiently high to operate the filter, and will be in the range 50 to 600 psi (3.5 to 42 kg/cm$^2$), generally, or 100 to 200 psi (7 to 14 kg/cm$^2$), preferably.

We have discovered that the improvement in filtration rate obtained by direct addition of calcium salt to the coal liquid can be greatly increased by premixing the calcium salt with a hydrocarbonaceous oil, such as a petroleum fraction or a coal liquid fraction, followed by addition of the mixture of the mineral-containing coal liquid. Any amount of hydrocarbonaceous liquid with which the calcium salt can form a stable, homogeneous mixture, dispersion or solution can be employed in preparing the premixture. Of course, the amount of liquid employed in preparing the premixture will be considerably smaller than the amount of liquid in the mineral-containing slurry being filtered.

A relatively small quantity of a substantially mineral-free coal liquid distillate fraction can be advantageously utilized in preparing the premixture. It is shown below that when the required amount of calcium carbonate is premixed with a relatively small quantity of the mineral-free recycle solvent utilized in the process for the solvation of the coal liquid being filtered, the improvement in the filtering rate that is achieved in a base test employing direct addition of calcium carbonate without premixing was increased significantly. This observed effect is especially surprising since the solvent fraction employed for premixing the calcium carbonate comprised about 70 weight percent of the mineral-containing coal liquid being filtered. It is seen that although the premixing solvent was equivalent to the solvent portion of the mineral-containing coal liquid, nonetheless, in the base test wherein solid calcium carbonate was added directly to the mineral-containing coal liquid already containing this solvent, a smaller improvement in filtration rate was achieved. The premixing liquid can be a coal or petroleum liquid fraction whose boiling range is within the boiling range of the coal liquid being filtered, or it can be a liquid whose boiling range extends below the boiling range of the coal liquid being filtered. Most preferably, it is a coal liquid fraction from which the coal minerals have been removed.

The amount of oil utilized in preparing the premixture can be insignificant compared with the amount of mineral-containing coal liquid being filtered. The amount of premixing oil need only be sufficient to form a stable and homogeneous mixture, suspension or solution with the calcium salt. If a greater amount of oil is employed for premixing, the greater amount may have a beneficial effect upon the filtering rate due to a reduction of viscosity of the coal liquid being filtered. However, the advantageous effect of the present invention can be achieved without using a sufficient amount of oil in forming the premixture to have a significant effect upon viscosity. Therefore, the effect of the present invention is achieved independently of and in addition to any viscosity effect.

In performing the filtration tests of the following examples, a 90 mesh screen located within the filter element was precoated to a depth of 0.5 inch (0.27 cm) with diatomaceous earth. The filter element measured 1.9 cm I.D. by 3.5 cm in height and provided a surface area of 2.84 cm$^2$. The screen was supported by a sturdy grid to prevent deformation. The precoat operation was performed by pressuring a 5 weight percent suspension of the diatomaceous earth precoat material in process light oil onto the screen using a nitrogen pressure of 40 psi (2.8 kg/cm$^2$). The precoat operation was performed at a temperature close to that of the subsequent filtering operation. The resulting porous bed of precoat material weighed about 1.2 grams. After the precoat material had been deposited, nitrogen at a pressure of about 5 psi (0.35 kg/cm$^2$) was blown through the filter for about 1-2 seconds to remove traces of light oil. The light oil flowed to a container disposed on an automatic weighing balance. The light oil was weighed to insure deposition of the required quantity of precoat material. Following this operation, the light oil was discarded. The balance was linked to a recorder for later use which provided a continuous (at 5 second intervals) printed record of filtrate collected as a function of time.

A 750 gram sample of unfiltered oil (UFO) without any additive was then introduced into a separate autoclave vessel which acted as a reservoir. The UFO was maintained at a temperature of 100-130° F. (38-54° C.) and was continuously stirred. Stirring was accomplished using two 5 cm diameter turbines. The shaft speed was 2,000 rpm. The filtration was begun by applying a selected 40-80 psi (2.8 to 5.6 kg/cm$^2$) nitrogen pressure to the autoclave. The UFO flowing from the autoclave passed through a preheater coil whose residence time was controlled by the manipulation of valves and which was provided with inlet and outlet thermocouples so that the UFO reaching the filter was maintained at a uniform temperature. The UFO passed from the preheater to the filter where solid cake was formed and filtrate obtained. The filter element and filter heater were also fitted with thermocouples. As indicated above, filtrate was recovered on a balance and its weight was automatically recorded every 5 seconds. The filtrate was collected in a clean container.

Comparative tests to determine the effect of a calcium carbonate-containing additive were performed using the same feed lot of UFO for which filtration data had been collected. First, the system tubing and the filter were purged of UFO with nitrogen at a pressure of about 100 psi (7 kg/cm$^2$). The additive was introduced into the autoclave reservoir containing UFO. A separate filter element was fitted and precoated in the same manner as described above and the tests employing an additive in the UFO were performed as described in the following examples. Following each filtration, the residue on the precoat material in the filter was purged with nitrogen and washed with an appropriate liquid to eliminate the UFO.

Following is an analysis of a typical unfiltered SRC feed coal liquid employed in the tests of the following examples. Although some light oil is flashed from the oil feed to the filter in process pressure step-down stages, the filter feed oil had not experienced removal of any of its solids content prior to filtration.

Specific gravity, 60° F. (15.6° C.), 1.15
Kinematic viscosity at 210° F. (98.9° C.), 24.1 centistokes
Density at 60° F. (15.6° C.), 1.092
Ash, 4.49 weight percent
Pyridine insolubles, 6.34 weight percent
Distillation, ASTM D1160

| Percent | Temp. ° F. (° C.) at 1 atm. |
|---|---|
| 5 | 518 (270) |
| 10 | 545 (285) |
| 20 | 566 (297) |
| 30 | 602 (317) |
| 40 | 645 (341) |

-continued

| Percent | Temp. ° F. (° C.) at 1 atm. |
|---|---|
| 50 | 695 (368) |
| 60 | 768 (409) |
| 70 | 909 (487) |
| 71-recovery of all distillables occurs at 925° F. (466° C.) | |

EXAMPLE 1

A slurry of mineral residue-containing coal liquid was filtered at a temperature of 500° F. (260° C.) with a filter pressure drop of 80 psi (5.6 kg/cm$^2$). The coal liquid filtered in these tests, denoted as Feed A, was filtered with and without added calcite. In the test employing calcite, the calcite was sprinkled into the coal liquid without premixing at room temperature and the liquid was then stirred. Subsequently, the mixture was heated to filtration temperature. The calcite formed a homogeneous mixture or dispersion. The filtering rates reported are for the first minute of filtration.

| Coal liquid | Additive, weight percent | Filtration rate (g/min) |
|---|---|---|
| Feed A | none | 4.5 |
| Feed A | calcite, 2.7% | 5.8 |

The data show that the non-premixed calcite additive imparted a significant improvement in filtering rate.

EXAMPLE 2

The filtering conditions employed in this example were similar to the filtering conditions of the tests of Example 1 except that the coal liquid containing the added calcite was held at the filtration temperature for 60 minutes prior to filtration.

| Coal liquid | Additive, weight percent | Filtration rate (g/min) |
|---|---|---|
| Feed A | none | 4.5 |
| Feed A | calcite, 1.3% | 6.8 |
| Feed A | calcite, 2.7% | 5.7 |

A comparison of the 2.7% calcite tests of this example and of Example 1 indicates similar results are achieved whether or not the calcite-filter feed mixture is held at filtration temperature for 60 minutes prior to filtration.

EXAMPLE 3

Filtering tests were preformed using a mineral residue-containing coal liquid, denoted as Feed B. The temperature of the coal liquid during the filtration tests was 500° F. (260° C.) and the pressure drop across the filter was 80 psi (5.6 kg/cm$^2$). One test was performed without a filter aid, while another test was performed after suspending a diatomaceous earth filter aid in the coal liquid. In the tests, the filter was precoated with a filter aid as described above. The filtering rates reported are for the first minute of filtration.

| Coal liquid | Additive, weight percent | Filtration rate (g/min) |
|---|---|---|
| Feed B | none | 3.9 |

-continued

| Coal liquid | Additive, weight percent | Filtration rate (g/min) |
|---|---|---|
| Feed B | diatomaceous earth, 1% | 2.4 |

The above data show that a body feed diatomaceous earth filter aid has a negative effect upon filtration rate. It is known in the art that filter aids which exert a mechanical or non-chemical effect are not beneficial when employed as a body feed in the filtration of coal liquids, i.e., when mixed with the feed liquid flowing to the filter. It is also known in the art that filter aids whose effect is mechanical do exert a beneficial effect in the filtration of coal liquids when employed as a filter precoat material.

EXAMPLE 4

Additional filtering tests were performed using a mineral-containing coal liquid, designated as Feed C, to compare the effect of various non-reactive materials with non-premixed calcite upon the filtration rate of the coal liquid. The tests were performed with the coal liquid at a temperature of 500° F. (260° C.) with a filter pressure drop of 80 psi (5.6 kg/cm$^2$). In all tests, the filter was precoated with a filter aid as described above. The filtration rates reported are for the first minute of filtration.

| Coal liquid | Additive, weight percent | Additive particle size | Filtration rate (g/min) |
|---|---|---|---|
| Feed C | none | — | 1.0 |
| Feed C | sand, 0.7% | 80–100 mesh | 1.1 |
| Feed C | neutral alumina, 0.7% | 80–100 mesh | 0.3 |
| Feed C | calcite, 0.7% | <325 mesh | 2.2 |

The above data show that calcite effected a substantial improvement in filtration rate, while sand and neutral alumina accomplished little or no improvement in filtration rate. Since sand and neutral alumina presumably exert a mechanical effect at the filter without benefit, it is apparent that calcite achieves its advantage in a different manner, i.e., by a chemical effect.

EXAMPLE 5

Test were performed to illustrate the effect to temperature upon the filtration rate of a mineral-containing coal liquid, designated as Feed D, in admixture with non-premixed calcite. In these tests a coal liquid distillate fraction boiling between 120 and 368° F. (49 and 187° C.) was added independently of and prior to the addition of the calcite, which was sprinkled into the coal liquid as a solid. In none of the tests was a mixture of calcite and light oil added to the coal liquid. The pressure drop for each test was 80 psi (5.6 kg/cm$^2$), and the temperature of the liquid was either 400 or 500° F. (204 or 260° C.). The reported filtration rates are for the first minute of filtration.

| Coal liquid | Filtration temp.-° F. | Additive, weight percent | Filtration rate (g/min) |
|---|---|---|---|
| Feed D | 500 | none | 2.6 |
| Feed D | 500 | 5% light oil | 3.9 |
| Feed D | 500 | 5% light oil + 1% calcite | 4.3 |
| Feed D | 400 | 5% light oil | 3.0 |
| Feed D | 400 | 5% light oil + 1% calcite | 2.8 |
| Feed D | 400 | 9% light oil | 3.7 |
| Feed D | 400 | 9% light oil + 1% calcite | 3.7 |
| Feed D | 400 | 9% light oil + 2% calcite | 3.4 |
| Feed D | 400 | 14% light oil | 4.8 |

-continued

| Coal liquid | Filtration temp.-° F. | Additive, weight percent | Filtration rate (g/min) |
|---|---|---|---|
| Feed D | 400 | 14% light oil + 1% calcite | 4.5 |

The above data show that at a filtering temperature of 500° F. (260° C.), the use of a light oil without calcite increased the filtration rate, and that the addition of non-premixed calcite resulted in a further improvement in the filtration rate. At a filtration temperature of 400° F. (204° C.), the presence of progressively increasing amounts of light oil provided progressively improved filtration rates due to a reduction in viscosity, but the addition of calcite either did not further increase or slightly reduced the filtering rate. These data indicate that the beneficial effect of calcite is temperature dependent and strongly indicates that the effect exerted by the calcite is chemical in nature. If the effect exerted were mechanical in nature, as in the case of a conventional filter aid, an advantage in the use of calcite would have also been apparent in the tests performed at 400° F. (204° C.).

EXAMPLE 6

Tests were performed to show the effect of adding the calcite to the coal liquid as a premixture of calcite in a small quantity of process solvent (B.R. 489 to 866° F.) (254 to 463° C.). The process solvent is a recycle distillate function of the coal liquid being produced. It is highly significant that the mineral-containing coal liquid which was being filtered already comprised about 70 weight percent of this solvent. In preparing the premixture the amount of solvent employed was insignificant compared to the amount of the coal liquid and was not sufficiently large to affect the viscosity of the coal liquid. These filtration tests were performed with Feed A of Example 1 at a temperature of 500° F. (260° C.), using a filter pressure drop of 80 psi (5.6 kg/cm$^2$). The filtration rates reported are for the first minute of filtration. The last three tests reported were performed after the mineral-containing coal liquid containing calcite was held at filtration temperature for 60 minutes prior to filtration. In the tests wherein the calcite was added directly to the coal liquid without process solvent, the calcite was sprinkled into the coal liquid, followed by stirring.

| Coal liquid | Additive, weight percent | Additive added in slurry with process solvent | Filtration rate(g/min) |
|---|---|---|---|
| Feed A | None | — | 4.5 |
| Feed A | calcite, 1% | Yes | 7.1 |
| Feed A | calcite, 1.5% | Yes | 8.6 |
| Feed A | calcite, 1% | No | 6.8 |
| Feed A | calcite, 2.3% | Yes | 7.5 |
| Feed A | calcite, 2.7% | No | 5.7 |

The above data show that the direct addition of calcite to the coal liquid without process solvent imparted a substantial increase in filtration rate. The data further show that this increase in filtration rate was considerably increased when the calcite was added as a mixture in a small quantity of the same solvent oil that comprised about 70 weight percent of the mineral-containing coal liquid being filtered.

We claim:

1. In a process for separating particles of coal minerals from a coal liquid in which they are suspended, the improvement comprising adding a mixture of a calcium salt and hydrocarbonaceous oil to said coal liquid prior to the separation step, the addition of said mixture increasing the rate of separation of the coal mineral particles from the coal liquid.

2. The process of claim 1 wherein said calcium salt is calcium carbonate.

3. The process of claim 2 wherein the calcium carbonate is calcite.

4. The process of claim 2 wherein the calcium carbonate is aragonite.

5. The process of claim 1 wherein the calcium salt is calcium acetate.

6. The process of claim 1 wherein the calcium salt is $CaCO_3 . MgCO_3$.

7. The process of claim 1 wherein the separation step is a filtration step.

8. The process of claim 1 wherein the separation step is a settling step.

9. The process of claim 1 wherein the ratio of calcium salt to coal liquid is between about 1 and 100 grams per liter.

10. The process of claim 1 wherein the ratio of calcium salt to coal liquid is between about 10 and 50 grams per liter.

11. The process of claim 1 wherein the coal liquid is at a temperature above 400° F. during the separation step.

12. The process of claim 1 wherein the coal liquid is at a temperature above 425° F. during the separation step.

13. The process of claim 1 wherein the coal liquid contains carbon dioxide.

14. The process of claim 1 wherein the hydrocarbonaceous oil is a petroleum oil.

15. The process of claim 1 wherein the hydrocarbonaceous oil is a distillate coal liquid.

16. The process of claim 1 wherein the hydrocarbonaceous oil is a distillate fraction of the coal liquid containing the coal minerals.

17. The process of claim 1 wherein the hydrocarbonaceous oil is the solvent used to produce the coal liquid.

18. The process of claim 1 wherein the separation step is a filtration step and a precoat material is first applied to the filter.

* * * * *